US006461477B1

(12) United States Patent
Nguyen et al.

(10) Patent No.: US 6,461,477 B1
(45) Date of Patent: Oct. 8, 2002

(54) PROTEINS AND POLYMERS FOR USE AS PITCH AND STICKIES CONTROL AGENTS IN PULP AND PAPERMAKING PROCESSES

(75) Inventors: Duy T. Nguyen, Austin, TX (US); Qu-Ming Gu, Hockessin, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/816,735

(22) Filed: Mar. 22, 2001

Related U.S. Application Data

(60) Provisional application No. 60/191,556, filed on Mar. 23, 2000.

(51) Int. Cl.[7] ..... D21C 9/08; D21F 7/06

(52) U.S. Cl. ..... 162/199; 162/174; 162/168.1; 162/181.8; 162/DIG. 4

(58) Field of Search ..... 162/174, 48, 199, 162/DIG. 4, 168.1, 168.2, 168.3, 181.1, 181.4, 181.8

(56) References Cited

U.S. PATENT DOCUMENTS

| | | | | |
|---|---|---|---|---|
| 4,964,955 A | * | 10/1990 | Lamar et al. | 162/164.6 |
| 5,711,853 A | | 1/1998 | Virnelson et al. | 162/143 |
| 5,885,419 A | | 3/1999 | Nguyen et al. | |
| 6,333,005 B1 | * | 12/2001 | Nguyen | 422/13 |

FOREIGN PATENT DOCUMENTS

| | | |
|---|---|---|
| WO | WO 97/44519 | 11/1997 |

OTHER PUBLICATIONS

Britten M. and Gaudin V., "Heat–treated whey protein hydrolysates: emulsigying and foaming properties", Milchwissenschraft 49 (12) (1994): 688–692.

Waniska, Ralph D.; Shetty, Jayarama K.; and Kinsella, John E. "Protein–Stabilized Emulsions: Effects of Modification on the Emulsifying Activity of Bovine Serum Albumin in a Model System", *J. Agric. Food Chem.* 29, (1981): 826–831.

Thompson, L.U. and Reyes, E.B., "Modification of Heat Coagulated Whey Protein Concentrates by Succinylatin", *J. Dairy Sci.*, vol. 63, (5) (1980): 715–721.

Mattarella, Nina L.; Crvamer, Lawrence K.; and Richardson, Thomas, "Amidation of Esterification of Bovine β–Lactoglobulin to Form Positively Charged Proteins", *J. Agric. Food Chem.* 31 (1983): 868–872.

* cited by examiner

*Primary Examiner*—Dean T. Nguyen
(74) *Attorney, Agent, or Firm*—Gary A. Samuels; Joanne M. Rossi

(57) ABSTRACT

Methods for inhibiting the depositions of organic contaminants from pulp in pulp and papermaking systems are disclosed. A combination of a protein and a cationic polymer is added to the pulp or applied to deposition prone surfaces of a papermaking system.

10 Claims, No Drawings

PROTEINS AND POLYMERS FOR USE AS PITCH AND STICKIES CONTROL AGENTS IN PULP AND PAPERMAKING PROCESSES

This application claims the benefit of U. S. Provisional Application No. 60/191,556 filed Mar. 23, 2000.

FIELD OF THE INVENTION

The present invention relates to methods for inhibiting the deposition of organic contaminants in pulp and papermaking systems.

BACKGROUND OF THE INVENTION

The deposition of organic contaminants (i.e., pitch and stickies) on surfaces in the papermaking process is well known to be detrimental to both product quality and the efficiency of the papermaking process. Some components occur naturally in wood and are released during various pulping and papermaking processes. Two specific manifestations of this problem are referred to as pitch (primarily natural resins) and stickies (adhesives or coatings from recycled paper). Pitch and stickies have many common characteristics including: hydrophobicity, tackiness, low surface energy, and the potential to cause problems with deposition, quality, and efficiency in the process as mentioned above.

The term "pitch" can be used to refer to deposits composed of organic constituents which may originate from these natural resins, their salts, as well as coating binders, sizing agents, and defoaming chemicals which may be found in the pulp. In addition, pitch frequently contains inorganic components such as calcium carbonate, talc, clays, titanium and related materials.

Stickies is a term that has been increasingly used to describe deposits that occur in the systems using recycled fiber. These deposits often contain the same materials found in "pitch" deposits in addition to adhesives, hot melts, waxes, and inks. All of the aforementioned materials have many common characteristics including: hydrophobicity, defoamability, tackiness, low surface energy, and the potential to cause problems with deposition, quality, and efficiency in the process. Table I shows the complex relationship between pitch and stickies discussed here.

TABLE I

| | Pitch | Stickies |
|---|---|---|
| Natural Resins (fatty and resin acids, fatty esters, insoluble salts, sterols, etc.) | X | X |
| Defoamers (oil, EBS, silicate, silicone oils, ethoxylated compounds, etc.) | X | X |
| Sizing Agents (Rosin size, ASA, AKD, hydrolysis products, insoluble salts, etc.) | X | X |
| Coating Binders (PVAC, SBR) | X | X |
| Waxes | | X |
| Inks | | X |
| Hot Melts (EVA, PVAC, etc.) | | X |
| Contact Adhesives (SBR, vinyl acrylates, polyisoprene, etc.) | | X |

The deposition of organic contaminants, such as pitch and stickies, can be detrimental to the efficiency of a pulp or paper mill causing both reduced quality and reduced operating efficiency. Organic contaminants can deposit on process equipment in papermaking systems resulting in operational difficulties in the systems. The deposition of organic contaminants on consistency regulators and other instrument probes can render these components useless. Deposits on screens can reduce throughput and upset operation of the system. This deposition can occur not only on metal surfaces in the system, but also on plastic and synthetic surfaces such as machine wires, felts, foils, Uhle boxes and headbox components.

Historically, the subsets of the organic deposit problems, "pitch" and "stickies" have manifested themselves separately, differently and have been treated distinctly and separately. From a physical standpoint, "pitch" deposits have usually formed from microscopic particles of adhesive material (natural or man-made) in the stock which accumulate on papermaking or pulping equipment. These deposits can readily be found on stock chest walls, paper machine foils, Uhle boxes, paper machine wires, wet press felts, dryer felts, dryer cans, and calendar stacks. The difficulties related to these deposits included direct interference with the efficiency of the contaminated surface, therefore, reduced production, as well as holes, dirt, and other sheet defects that reduce the quality and usefulness of the paper for operations that follow like coating, converting or printing.

From a physical standpoint, "stickies" have usually been particles of visible or nearly visible size in the stock which originate from the recycled fiber. These deposits tend to accumulate on many of the same surfaces that "pitch" can be found on and causes many of the same difficulties that "pitch" can cause. The most severe "stickies" related deposits however tend to be found on paper machine wires, wet felts, dryer felts and dryer cans.

Methods of preventing the build-up of deposits on the pulp and paper mill equipment and surfaces are of great importance to the industry. The paper machines could be shut down for cleaning, but ceasing operation for cleaning is undesirable because of the consequential loss of productivity, poor quality while partially contaminated and "dirt" which occurs when deposits break off and become incorporated in the sheet. Preventing deposition is thus greatly preferred where it can be effectively practiced.

In the past stickies deposits and pitch deposits have typically manifested So themselves in different systems. This was true because mills usually used only virgin fiber or only recycled fiber. Often very different treatment chemicals and strategies were used to control these separate problems.

Current trends are for increased mandatory use of recycled fiber in all systems. This is resulting in a co-occurrence of stickies and pitch problems in a given mill. It is desirable to find treatment chemicals and strategies which will be highly effective at eliminating both of these problems without having to feed two or more separate chemicals.

It was suggested that gelatin could be used as a remedy for pitch control. U.S. Pat. No. 5,885,419, the entire content of which are wherein incorporated by reference discloses blood-related proteins such as albumins and globulins for preventing pitch/stickies deposition in the pulp and paper industry. However, the milk protein used in the patent proved to be ineffective. The patent does not reveal the physical/chemical properties of this milk protein; however, its poor performance indicates the exclusion of he high molecular weight whey proteins which surprisingly found to be very effective in this invention.

BRIEF SUMMARY OF THE INVENTION

The present invention provides for compositions and methods for inhibiting the depositions of organic contaminants from pulp and papermaking systems.

The present invention provides for methods for inhibiting the deposition of organic contaminants, such as pitch and stickies, in pulp and papermaking systems. The methods comprise adding to the pulp or applying to the surfaces of papermaking machinery an effective deposition inhibiting amount of a combination of a whey protein and a cationic polymer.

DETAILED DESCRIPTION OF THE INVENTION

The present invention relates to methods for inhibiting the deposition of organic contaminants from pulp on the surface of papermaking machinery in pulp and papermaking systems comprising adding to pulp or applying to the surfaces of the paper making machinery an effective deposition inhibiting amount of a whey protein. The present invention provides for methods for inhibiting the deposition of organic contaminants, such as pitch and stickies, from pulp and papermaking systems.

Organic contaminants include constituents which occur in the pulp (virgin, recycled or combinations thereof) having the potential to deposit and reduce paper machine performance or paper quality. These contaminants include but are not limited to natural resins such as fatty acids, resin acids, their insoluble salts, fatty esters, sterols; and other organic constituents such as ethylene bis-stearamide, waxes, sizing agents, adhesives, hot melts, inks, defoamers, and latexes which may deposit in papermaking systems.

There are two fundamentally different groups of proteins present in milk, casein and whey. Casein proteins are heat insensitive. Whey proteins are heat sensitive. Table I shows the major differences in properties between casein and whey proteins, including the major proteins in each group and their percentage contribution to the total protein in milk.

TABLE I

Properties of Milk Proteins and Their Major Components

| Protein Type | Structures and properties | Individual Proteins | Protein in milk % |
|---|---|---|---|
| Casein | Contains strongly hydrophobic regions, random coil structure and little cysteine. Heat stable, but unstable in acidic conditions | $\alpha_S$-casein | 45–55 |
| | | β-casein | 23–35 |
| | | κ-casein | 8–15 |
| | | casein | 3–7 |
| Whey | Contains both hydrophilic and hydrophobic residues, cysteine and cystine, Globular structure with much helical content. Easily heat denatured. Stable in mildly acidic conditions | β-lactoglobulin | 7–12 |
| | | α-lactalbumin | 2–5 |
| | | Proteose peptone | 2–6 |
| | | Immunoglobulins | 2–3 |
| | | Bovine Serum Albumin | ca 1 |

As can be seen, β-lactoglobulin is the major component of the whey protein. The average molecular weight of the whey protein is from about 3000 to about 25,000.

As demonstrated in Table II, there are distinct differences in the composition of proteins such as gelatin, serum albumin, casein, and whey protein that can be seen in their amino acid content.

TABLE II

Amino Acid Composition of Selected Proteins

| Amino Acid | Whey (i.e., milk protein) | Casein (i.e., milk protein) | Gelatin (i.e., hydrolyzed collagen) | Serum Albumin (i.e., blood protein) |
|---|---|---|---|---|
| Alanine | 3.3 | 2.8 | 7 | 0.6 |
| Arginine | 2.4 | 3.5 | 8 | 4.9 |
| Aspartic Acid | 10.3 | 6.6 | 6 | 9 |
| Cystein | 2.4 | 0.3 | 0.1 | 3.9 |
| Glutamic Acid | 16.6 | 20.3 | 10 | 15.6 |
| Glycine | 1.7 | 1.8 | 23 | 2.9 |
| Histidine | 1.9 | 2.7 | 0.7 | 3.1 |
| Hydroxylysine | — | — | 1 | — |
| Hydroxyproline | — | — | 12 | — |

TABLE II-continued

Amino Acid Composition of Selected Proteins

| Amino Acid | Whey (i.e., milk protein) | Casein (i.e., milk protein) | Gelatin (i.e., hydrolyzed collagen) | Serum Albumin (i.e., blood protein) |
|---|---|---|---|---|
| Isoleucine | 6.4 | 4.9 | 1 | 1.8 |
| Leucine | 9.9 | 8.7 | 3 | 11.3 |
| Lysine | 9.5 | 7.5 | 3 | 11.3 |
| Methionine | 2 | 2.6 | 0.8 | 1.2 |
| Phenylalanine | 3 | 4.8 | 2 | 6.4 |
| Proline | 6.1 | 10.6 | 15 | 6 |
| Serine | 5.1 | 5.6 | 3 | 4.3 |
| Threonine | 7.1 | 4.3 | 2 | 5.3 |
| Tyrosine | 2.9 | 5.3 | 0.4 | 3.5 |
| Valine | 6.1 | 6.2 | 2 | 8.8 |
| Tryptophan | 2 | 1.5 | — | 0.2 |

Casein protein that is largely phosphorylated in its natural form is much more hydrophilic than whey proteins, without being bound by theory, it is theorized that the hydrophilicity may prevent it from interacting with the hydrophobic stickies/pitch particles and thereby, become an inefficient pitch/stickies control agent. In contrast, similar to bovine serum albumin, β-lactoglobulin and α-lactalbumin, the major components of whey protein apparently are more globular structurally than casein since it has a higher content of cystein with which proteins crosslink themselves through disulfide bonds. The globular structure as well as the hydrophobicity of the whey protein increases its interaction with the hydrophobic stickies and pitch particles. Without being bound by theory, this may explain the better performance of the whey protein when compared to casein. Casein is more linear chemically because of lack of the disulfide bonds in the protein. The whey proteins having molecular weights in the range of at least about 3,000, preferably at least about 5000, and even more preferably at least about 10,000 and up to about 30,000, more preferably up to about 25,000 and even more preferably about 20,000, are useful in the present investigation. Whey protein hydrolysate of the molecular weight less than 2,000 derived from a protease-treatment did not show desired properties (Table II), without wishing to be bound by theory, this is an indication that the intact globular structure of the protein is necessary for the physical property.

The whey protein is used in an amount effective to inhibit the deposition of organic contaminant such as pitch and stickies.

For purposes of the present invention, the term "an effective deposition inhibiting amount" is defined as that amount which is sufficient to inhibit deposition in pulp and papermaking systems. Generally, the whey protein is used in an amount of at least from about 0.1 ppm, preferable at least from about 0.5 ppm and more preferable at least from about 1 ppm bases on the parts of dry pulp in the system.

The whey protein can be used in the presence of electrolytes with little or no negative impact as to the effectiveness of the whey protein for inhibiting the deposition of organic contaminant, such as pitch and stickies from pulp and paper making systems.

The whey protein can be used in both basic and acidic environments. The pH can be as high as about 14 or as low as 1.

The whey protein can be used in a temperature range of from at least about 15 C., more preferable 20 C., even more preferable about 25 C. to a temperature of about 70 C. and more preferable 60 C. and even more preferably from about 55 C. The molecular weight of the whey protein used in the invention is from about 5,000 to about 30,000, preferably from about 10,000 to about 25,000 and more preferable from about 17,000 to about 21,000. The whey proteins used in the invention are commercially available and available from Calpro Ingredients.

The whey proteins of the present invention are effective at inhibiting the deposition of organic contaminants in papermaking systems. This may include but not limited to Kraft, acid sulfite, mechanical pulp and recycled fiber systems. For example, deposition in the brown stock washer, screen room and decker system in Kraft papermaking processes can be inhibited. The term "papermaking systems" is meant to include all pulp processes. Generally, it is thought that whey proteins can be utilized to inhibit deposition on all surfaces of the papermaking system from the pulp mill to the reel of the paper or pulp machine having a pH from at least about 1 and can range to as high as 14 under a variety of system conditions. More specifically, the whey proteins effectively decrease the deposition not only on metal surfaces but also on plastic and synthetic surfaces such as machine wires, felts, foils, Uhle boxes, rolls and headbox components.

The whey proteins of the present invention may be compatible with other pulp and papermaking additives. These can include starches, titanium dioxide, defoamers, wet strength resins, and sizing aids.

The whey proteins of the present invention can be added to the papermaking system at any stage. They may be added directly to the pulp furnish or indirectly to the furnish through the headbox. The whey proteins may also be applied to surfaces that can suffer from deposition, such as the wire, press felts, press rolls and other deposition-prone surfaces. Application onto the surfaces can be by means of spraying or by any other means that coats the surfaces.

The whey proteins of the present invention can be added to the papermaking system neat, as a powder, slurry or in solution, the preferred primary solvent being water but is not limited to such. Examples of other carrier solvents include, but are not limited to, water soluble solvents such as ethylene glycol and propylene glycol. When added by spraying techniques, the inventive composition is preferably diluted with water or other solvent to a satisfactory inhibitor concentration. The whey proteins may be added specifically and only to a furnish identified as contaminated or may be added to blended pulps. The whey proteins may be added to the stock at any point prior to the manifestation of the deposition problem and at more than one site when more than one deposition site occurs. Combinations of the above additive methods may also be employed by feeding either the whey proteins, by way of feeding the pulp millstock, feeding to the paper machine furnish, and/or spraying on the wire and the felt simultaneously.

The effective amount of the whey proteins to be added to the papermaking system depends on a number of variables including but not limited to the temperature of the water, additional additives, and the organic contaminant type and content of the pulp. Generally, from at least about 0.1 parts, preferably at least about 0.5 parts, more preferably about 1 parts, and more preferably about 1.5 parts of the whey proteins per million parts of pulp in the system is added.

Further, the whey proteins have proven effective against both the pitch and stickies manifestation of organic deposition problems providing for an effective reduction of these problems in paper mills utilizing a variety of virgin and recycled fiber sources.

In paper machine systems that are closed loop or have water recycle systems it is advantageous to remove pitch and stickies to prevent accumulation in the water system. Screening is one method of removing pitch and stickies. In a preferred method, the pitch and stickies do not accumulate in the recycled water but are removed by combining them with the forming paper. In this preferred method the pitch and stickies are incorporated into the forming paper in a size and condition (detackified) that the forming paper quality is not detrimentally affected. It has surprising been found that by adding protein and cationic polymers to the paper making system, pitch and stickies are removed from the water system by combining with the forming paper. Such polymers are sometimes used for the retention of fines and filler material but may also be used to retain pitch and stickies.

In one aspect of the invention, cationic polymers may be used in combination with proteins. Proteins that by themselves have some effectiveness to reduce deposition of pitch and stickies can advantageously be used together with cationic polymers to further reduce the deposition of pitch and stickies.

Proteins useful in this aspect of the invention, that can be combined with the cationic polymers, include but are not limited to, whey protein, soy protein, ovalbumin, serum albumin, lactoglobulin, casein, gelatin, wheat protein, and collagen; preferably the protein is whey protein.

Cationic polymers useful in the invention include but are not limited to cationic starch, cationic polyacrylamide, alum, cellulose derivatives, polyamine such as condensation polymers produced from aliphatic amines and epichlorohydrin, polyamide amine condensate, polyamide-amine-epichlorohydrin resins, polyethylene imine, polyethylene oxide, polydiallyl-dimethyl-ammonium chloride( poly DADMAC), and melamine-formaldehyde resin. The polyacrylamides useful in the present invention include co-polymers, terpolymers and other combinations providing cationicity to a polyacrylamide polymer backbone.

Although the above cationic polymers may be pre-mixed with the proteins, the former may also be added to the aqueous system separate from the proteins, either before or after the proteins. The polymers and/or the proteins may be added together or separately directly to the pulp furnish or indirectly to the furnish through the headbox. It is particularly advantageous to add the protein first, mix until the protein has been evenly distributed in the furnish and then add the cationic polymer before sheet formation.

The polymers and/or the proteins may also be applied together or separately to surfaces that can suffer from deposition, such as the wire, press felts, press rolls and other deposition-prone surfaces. Application onto the surfaces can be by means of spraying or by any other means that coats the surfaces.

The blends of protein and cationic polymers are used at weight ratios of protein to cationic polymer of from about 1:1 to about 1:100, preferably from about 1:1 to about a 1:50, and more preferably from about 1:1 to about 1:20, are often more effective than the individual components.

It has been found that the cationic polymer, poly DADMAC, may improve the pitch/stickies inhibition effect of the protein's ability to reduce the tendency for deposition of pitch and stickies. For example, blends of a whey protein of the present invention and poly DADAMAC at weight ratios protein to cationic polymer of from about 1:1 to about 1:100, preferably from about 1:1 to about 1:50, and more preferably from about 1:1 to about 1:20, are sometimes more effective than the individual components.

The effective amount of protein plus cationic polymer to be added to the papermaking system depends on a number of variables including but not limited to the temperature of the water, additional additives, and the organic contaminant type and content of the pulp. Generally, from at least about 0.1 parts, preferably at least about 0.5 parts, more preferably about 1 parts, and more preferably about 1.5 parts of the protein plus cationic polymer per million parts of pulp in the system is added.

There are several advantages associated with the present invention compared to prior processes. These advantages include an ability to function without being greatly affected by the hardness content of the water in the system or the pH; an ability to function at low dosages; an ability to function while not adversely affecting sizing and fines retention, reduced environmental impact; generally recognized as safe material (GRAS); an ability to allow the user to use a greater amount of recycled fiber in the furnish; and improved biodegradability.

The data below were developed to demonstrate the unexpected results obtained by the use of the present invention.

EXAMPLES

Standard Tape Detackification Test (STDT)

In order to establish the efficacy of the inventive compositions as deposition control agents on plastic surfaces and specifically for adhesive contaminants of the sort found in recycled pulp, a laboratory test was developed utilizing adhesive-backed tapes as stickie coupons. The stickie coupon can be fabricated from any type of adhesive tape that will not disintegrate in water. For this study, tapes made from styrenebutadiene rubber and vinylic esters were used. Both of these potential organic contaminants are known to cause stickie problems in secondary fiber utilization. A second coupon was fabricated from polyester film such as MYLAR, a product marketed by E. I. Du Pont de Nemours Chemical Company. This material was chosen because paper machine forming fabrics are frequently made polyester which is susceptible to considerable deposition problems caused by stickies and/or pitch.

The test involved immersing a 2"×4" adhesive tape and a 2"×4" polyester Mylar coupon into a 600 gram solution being tested. The pH of all the solutions was about 6, unless otherwise noted. The solution contained in a 600 mL beaker was placed in a water bath with agitation and heated to the desired temperature. After 30 minutes of immersion, the tape and coupon were removed from the solution and pressed to 10,000 lb force for one minute. An Instron tensile test instrument was then used to measure the force required to pull the two apart. The reduction in the force required indicated that the "stickie" was detackified. The % control or detackification was calculated by the following equation:

$$\%\text{detackification}=100\times[(\text{untreated force}-\text{treated force})]/\text{untreated force}$$

The results of this testing are presented in Table III.

TABLE III

Standard Tape Detackification Test

| Treatment | Dosage (ppm), as actives | Temp. (° C.) | Electrolyte concentration | % Detackification |
|---|---|---|---|---|
| Whey protein hydrolysate (7.9% hydrolysis; average MW = 1,400) | 0.25 | 50 | 0 | 4.7 |
| | 0.5 | 50 | 0 | 2.7 |
| Whey protein hydrolysate (10% hydrolysis; avg MW = 1,100) | 0.25 | 50 | 0 | 6.8 |
| | 0.5 | 50 | 0 | 22.5 |
| Lactalbumin | 1 | 50 | 0 | 5.9 |
| Soy protein hydrolysate | 1 | 50 | 0 | 31.5 |
| Sodium caseinate | 0.5 | 50 | 0 | 23.8 |
| | 1 | 50 | 0 | 68.5 |
| Ammonium caseinate | 0.5 | 50 | 0 | 54.0 |
| | 1 | 50 | 0 | 77.8 |
| Calcium caseinate | 0.5 | 50 | 0 | 58.9 |
| | 1 | 50 | 0 | 76.1 |
| Whey protein (MW = from about 10,000 to about 25,000) | 0.25 | 50 | 0 | 96.5 |
| | 0.25 | 50 | 0 (pH 11) | 95.2 |
| | 0.5 | 50 | 0 | 98.7 |
| | 0.25 | 50 | 15 ppm calcium | 96.9 |
| | 0.25 | 50 | 100 ppm calcium | 98.5 |
| | 0.25 | 50 | 50 ppm sodium | 94.5 |
| | 0.25 | 50 | 200 ppm sodium | 97.1 |
| | 0.15 | 50 | 200 ppm sodium | 95.5 |
| | 0.10 | 50 | 200 ppm sodium | 79.7 |
| | 1 | 30 | 0 | 90.5 |
| | 0.5 | 30 | 0 | 87.3 |
| | 0.25 | 50 | 250 ppm calcium and 500 ppm sodium(pH = 4) | 98.2 |
| | 0.25 | 50 | 250 ppm calcium and 500 ppm sodium | 92.6 |
| Polyvinyl alcohol (87% hydrolyzed; MW = 110,000) | 0.25 | 50 | 250 ppm calcium and 500 ppm sodium | 92.6 |
| | 0.5 | 50 | 0 | 76.2 |

TABLE III-continued

| Standard Tape Detackification Test | | | | |
|---|---|---|---|---|
| Treatment | Dosage (ppm), as actives | Temp. (° C.) | Electrolyte concentration | % Detackification |
| | 1 | 50 | 0 | 93.4 |
| | 1 | 30 | 0 | 51 |
| | 2 | 30 | 0 | 67 |
| | 5 | 30 | 0 | 92 |

As demonstrated in Table III, whey protein proved much more effective than the whey protein hydrolysates, soy protein, lactalbumin, sodium caseinate, calcium caseinate, and ammononium caseinate. As mentioned previously, casein and whey are two proteins present in milk; however, they are chemically different. Without being bound by theory, the superior performance of the whey proteins as compared to the casein proteins may also be attributed to the balance of hydrophilic and hydophobic residues present in the whey proteins, as opposed to the strongly hydophilic surface of the casein proteins. The high molecular weight whey protein also appeared much more efficacious than the low molecular ones. It also can be seen that the presence of electrolytes (i.e., sodium and calcium ions) had no substantial negative impact on the performance of the whey protein. Furthermore, the high molecular weight protein still remained very effective at low temperatures (i.e., 30° C.) and under high pH conditions (i.e., pH 11).

Filtrate Turbidity Test

A filtrate turbidity and an observation of pitch deposition on a Teflon® stirring bar was used to evaluate protein and/or cationic polymer activity to prevent deposition as well as retain pitch particles onto fibers as shown by a decrease of pitch deposition on the Teflon bar and a decrease of the filtrate turbidity, respectively. Teflon® is manufactured by the E. I. Du Pont de Nemours Chemical Company.

Procedure

| Conditions | Reagents |
|---|---|
| pH = 5.5–6.0 | CaCl2.2H2O |
| 200 ppm $Ca^{+2}$ | Sylvatol 40 |
| 350 ppm pitch | Abietic Acid |
| 0.5% Consistency | HWD bleached Kraft Fiber |
| 50C | 50% NaOH |
| | Dilute HCl |
| | Calpro 75 |
| | BAP 5021 |
| | Polyplus 1279 |
| | DADMAC |

A. Preparation of Pitch Emulsion—0.5% pitch emulsion 1. 1800 ml DI water was heated to near boiling (with stir and covered w/aluminum foil)
2. Added 1.5 ml of 50% NaOH to bring pH to approx. 12 (~30 drops of 50% NaOH)
3. Dissolved 4.0 g of abietic acid
4. Dissolved 5.0 g of Sylvatol 40
5. Adjusted pH slowly to 8.0 with dilute HCl. The suspension became cloudy and milky B. Preparation of Fiber—1% consistency 1. Weighed 20 g dry lap bleached hardwood pulp tore into approx. 1"×1" pieces
2. Soaked in 2000 ml DI water for 15 min or more
3. Transferred soaked pulp to TAPPI Disintegrator container C. Operation of Brift Jar Test 1. Filled a 600 ml beaker with 250 g of a 1% consistency pulp slurry and 250 g of boiling DI water. Maintained the temp. near 50 C. by heating the beaker
2. Added Calcium solution (4 ml of 9.2% CaCl2.2H2O)
3. Added pitch suspension (35 g)
4. Added 5–20 ppm protein or cationic polymer (i.e., 10 ppm=5 g of 0.1% soln)
5. Adjusted pH with dilute HCl to 5.5–6.0 (checked pH probe in buffer to ensure that there was not a build up of pitch)
6. Stirred for 30 min
7. Added 5–20 ppm cationic polymer or protein
8. Stirred for 15 min
9. Transferred "7" to a Brit Jar equipped with a 22 micron screen and stirred. 800 RPM for 30 sec, filter, then the filtrate was collected for turbidity measurements.

The results of this testing are presented in Table IV:

TABLE IV

| Turbidity and Pitch Deposition Test | | |
|---|---|---|
| Treatment | Turbidity | Teflon deposition |
| Untreated | 426 | Slight amount of pitch deposition |
| 1 ppm poly DADMAC | 365 | Same as untreated |
| 2 ppm poly DADAMAC | 258 | Same as untreated |
| 5 ppm poly DADMAC | 198 | Same as untreated |
| 10 ppm poly DADMAC | 249 | Moderate amount of pitch deposition |
| 30 ppm poly DADMAC | 62 | Lots of deposition |
| 10 ppm whey protein | 395 | No pitch |
| 20 ppm whey protein | 370 | No pitch |
| 1 ppm whey protein ~/30 ppm poly DADMAC | 42 | Same as untreated |
| 5 ppm whey protein ~/30 ppm poly DADMAC | 21 | No pitch |
| 20 ppm whey protein /30 ppm poly DADMAC | 19 | No pitch |
| 20 ppm PVA | 403 | No pitch |
| 1 ppm PVA/30 ppm poly DADMAC | 70 | Same as untreated |
| 5 ppm PVA/30 ppm poly DADMAC | 96 | Same as untreated |
| 10 ppm PVA/30 ppm poly DADMAC | 88 | Same as untreated |
| 20 ppm PVA/30 ppm poly DADMAC | 103 | No pitch |
| 5 ppm whey protein adjusted to pH 12 then blended with 15 ppm poly DADMAC prior to adding to the pulp slurry | 24 | No pitch |

The whey protein used in the turbidity test had a molecular weight of from about 10,000 to about 25,000. Table IV shows that whey protein prevents pitch deposition on a Teflon bar as well as lowers the filtrate turbidity (an indication of pitch retention) when used in combination with a cationic polymer.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of inhibiting the deposition of organic contaminants in pulp and papermaking systems comprising adding to the pulp and papermaking system an effective deposition inhibiting amount of at least one protein and at least one cationic polymer, wherein the at least one protein is selected from the group consisting of whey protein having a molecular weight of about 3000 to about 30,000, soy protein, ovalbumin, serum albumin, lactoglobulin, casein, gelatin, wheat protein and collagen.

2. The method of claim 1, wherein the cationic polymer is selected from the group consisting of cationic starch, cationic polyacrylamide, alum, cellulose derivatives, condensation polymers produced from aliphatic amines and epichlorohydrin, polyamide amine condensate, polyamide-amine-epichlorhydrin resins, polyethylene imine, polyethylene oxide, polydiallyl-dimethyl-ammonium chloride, melamine-formaldehyde resin and mixtures thereof.

3. The method of claim 1, wherein at least one cationic polymer comprises poly diallydimethyl ammonium chloride.

4. The method of claim 1 wherein the organic contaminants are stickies deposits.

5. The method of claim 1 wherein the organic contaminants are pitch deposits.

6. A method of inhibiting the deposition of organic contaminants on the surfaces of papermaking machinery and equipment in pulp and papermaking systems comprising applying to the surfaces an effective deposition inhibiting amount of at least one protein and at least one cationic polymer, wherein the at least one protein is selected from the group consisting of whey protein having a molecular weight of about 3000 to about 30,000, soy protein, ovalbumin, serum albumin, lactoglobulin, casein, gelatin, wheat protein and collagen.

7. The method of claim 6, wherein the cationic polymer is selected from the group consisting of cationic starch, cationic polyacrylamide, alum, cellulose derivatives, condensation polymers produced from aliphatic amines and epichlorohydrin, polyamide amine condensate, polyamide-amine-epichlorhydrin resins, polyethylene imine, polyethylene oxide, polydiallyl-dimethyl-ammonium chloride, melamine-formaldehyde resin and mixtures thereof.

8. The method of claim 6, wherein at least one cationic polymer comprises poly diallydimethyl ammonium chloride.

9. The method of claim 6, wherein the organic contaminants are stickies deposits.

10. The method of claim 6, wherein the organic contaminants are pitch deposits.

* * * * *